US007876220B2

(12) United States Patent
Aldridge

(10) Patent No.: US 7,876,220 B2
(45) Date of Patent: Jan. 25, 2011

(54) GARMENT TRACKING AND PROCESSING SYSTEM

(75) Inventor: Jeffrey L. Aldridge, Lebanon, OH (US)

(73) Assignee: Cintas Corporation, Cincinnati, OH (US)

( * ) Notice: Subject to any disclaimer, the term of this patent is extended or adjusted under 35 U.S.C. 154(b) by 332 days.

(21) Appl. No.: 11/695,996

(22) Filed: Apr. 3, 2007

(65) Prior Publication Data

US 2008/0116273 A1 May 22, 2008

Related U.S. Application Data

(60) Provisional application No. 60/866,942, filed on Nov. 22, 2006, provisional application No. 60/894,706, filed on Mar. 14, 2007.

(51) Int. Cl.
*G08B 13/14* (2006.01)

(52) U.S. Cl. ..... 340/572.1; 340/568.1; 340/825.36

(58) Field of Classification Search ... 340/572.1–572.9, 340/522, 568.1, 825.32, 825.34, 5.91, 5.92, 340/825.36, 5.2
See application file for complete search history.

(56) References Cited

U.S. PATENT DOCUMENTS 4,403,425 A * 9/1983 Mussiger ..... 34/661
4,903,211 A * 2/1990 Ando ..... 701/200
5,222,137 A 6/1993 Barrett et al.
5,299,134 A * 3/1994 Speckhart et al. ..... 700/224
5,412,379 A 5/1995 Waraksa et al.
5,886,634 A * 3/1999 Muhme ..... 340/572.1
5,962,834 A 10/1999 Markman
6,085,914 A * 7/2000 Tobaccowala et al. ..... 209/702
6,116,849 A 9/2000 Fesmire et al.
6,814,284 B2 * 11/2004 Ehlers et al. ..... 235/383
7,142,118 B2 * 11/2006 Hamilton et al. ..... 340/572.1
7,246,510 B2 7/2007 Kim et al.
7,345,576 B2 * 3/2008 Allen et al. ..... 340/10.2
7,404,303 B1 7/2008 Barbosa et al.
7,471,199 B2 * 12/2008 Zimmerman et al. ..... 340/572.1
7,649,462 B2 1/2010 Ellis et al.
7,663,492 B2 2/2010 Bergman et al.
2005/0058292 A1 3/2005 Diorio et al.

(Continued)

FOREIGN PATENT DOCUMENTS

JP 9-258801 10/1997

(Continued)

OTHER PUBLICATIONS

International Search Report dated Oct. 30, 2008 for Application No. PCT/US08/67891.

(Continued)

*Primary Examiner*—Daniel Previl
(74) *Attorney, Agent, or Firm*—Wood, Herron & Evans, LLP

(57) ABSTRACT

A process for laundering, sorting and delivering garments is enhanced by incorporating a Radio Frequency IDentification (RFID) tag into each garment. An RFID reader antenna includes left and right interleaved parallel and vertically aligned pluralities of generally orthogonal ferrite horseshoes to shape the sensing magnetic fields. The span of coverage along with the non-aligned magnetic fields ensure that RFID tag is read even regardless of orientation. Accurate detection facilitates tracking of garments during laundering, repair, replacement, sorting, etc.

10 Claims, 8 Drawing Sheets

U.S. PATENT DOCUMENTS

| | | | | |
|---|---|---|---|---|
| 2005/0099303 | A1 | 5/2005 | Zuckerman | |
| 2005/0257259 | A1 | 11/2005 | Torre-Bueno | |
| 2006/0061482 | A1 | 3/2006 | Monney et al. | |
| 2006/0130243 | A1 | 6/2006 | Ozaltin et al. | |
| 2006/0163350 | A1 | 7/2006 | Melton et al. | |
| 2007/0129849 | A1 | 6/2007 | Zini et al. | |
| 2007/0182561 | A1 * | 8/2007 | Hassan-Zade et al. | 340/572.7 |
| 2008/0048035 | A1 | 2/2008 | Chabanne et al. | |
| 2008/0106386 | A1 | 5/2008 | Li et al. | |

FOREIGN PATENT DOCUMENTS

| | | |
|---|---|---|
| KR | 2007068743 | 7/2007 |

OTHER PUBLICATIONS

Written Opinion dated Oct. 30, 2008 for Application No. PCT/US08/67891.
Office Action dated May 27, 2010 for Application No. 11/695,964.
Office Action dated Dec. 2, 2009 for Application No. 11/696,006.
Office Action dated Jun. 11, 2010 for Application No. 11/696,006.

* cited by examiner

GARMENT TRACKING AND PROCESSING SYSTEM

CROSS REFERENCE TO RELATED APPLICATIONS

The present application hereby claims the benefit of the nonprovisional patent application Ser. No. 10/974,399, entitled "Garment Processing System and Method Thereof" to Jeffrey Aldridge, filed 27 Oct. 2004, and the two provisional patent application Ser. Nos. 60/866,942 and 60/894,706 filed respectively on filed 22 Nov. 2006 and 14 Mar. 2007, both to Jeffrey Aldridge and both entitled "Means For Limiting Access to Identifying Data", the disclosures of which are hereby incorporated by reference in their entirety.

The present application is related to two co-pending and commonly-owned nonprovisional patent applications filed on even date herewith entitled "Garment RFID Private Protocol Apparatus" and "Garment Processing Personnel Safety Apparatus", both to Jeffrey L. Aldridge, the disclosures of which are hereby incorporated by reference in their entirety.

FIELD OF THE INVENTION

The present invention relates, in general, to devices that enhance the productivity and safety associated with large volume garment processing (e.g., sorting, washing, drying, repair/replacement, storage and delivery), and more particularly to such improvements enabled by tracking individual garments by radio frequency identification (RFID) devices.

BACKGROUND OF THE INVENTION

Commercial and industrial laundering facilities have become increasingly sophisticated in order to meet customer demand efficiently and economically. These facilities are generally large-scale operations and are capable of laundering and organizing thousands of garments per day. Improvements to tracking garments are desirable.

BRIEF DESCRIPTION OF THE FIGURES

The accompanying drawings, which are incorporated in and constitute a part of this specification, illustrate embodiments of the invention, and, together with the general description of the invention given above, and the detailed description of the embodiments given below, serve to explain the principles of the present invention.

DETAILED DESCRIPTION OF THE INVENTION

Figure 1:
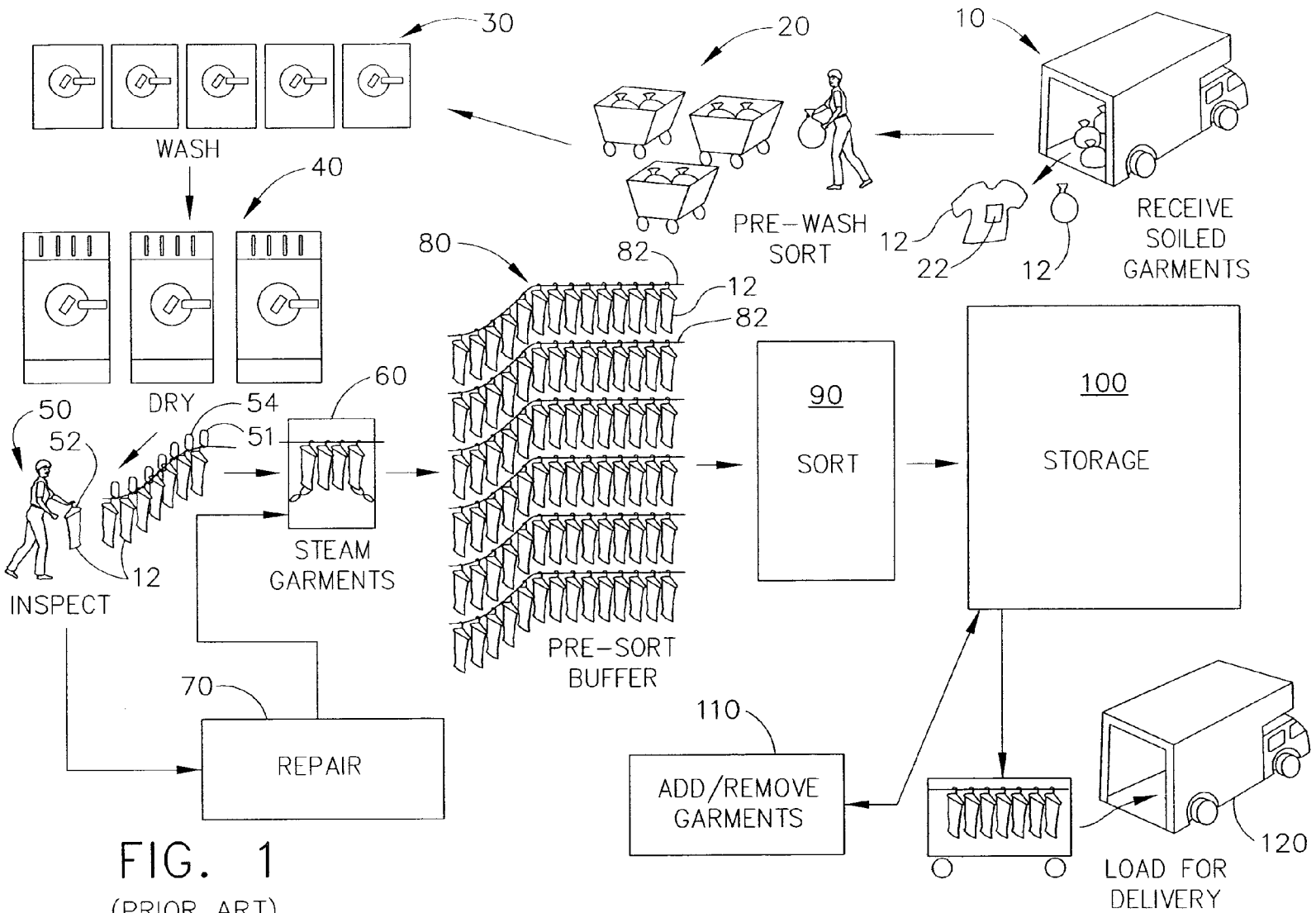
FIG. 1 (PRIOR ART)
FIG. 1 is a schematic representation of a generally-known example of a process for laundering, drying and sorting garments based upon a pre-sort buffer.

Referring now to the figures, FIG. 1 shows a schematic of a generally-known process for laundering, drying, and sorting garments. Garments 12, which are typically soiled, are delivered to the laundering facility by delivery vehicles 10, typically delivery trucks. Each delivery of soiled garments 12 corresponds to a specific route. The soiled garments 12 are unloaded from the vehicle and may undergo a pre-wash sort 20 where the garments 12 may be separated by the type of garment 12 (e.g. garage wear, lab wear, etc.), by color (e.g. light, dark, etc.) and the like. Each garment 12 may include a permanent or temporary unique identifier 22, such as an alphanumeric code, which may be unique to each garment or a class of garments. The identifier may be manually readable by workers or may be encoded in a machine readable format, such as a bar code, radio frequency (RF) chip, and the like. While the following embodiment is described in the context of machine readable identifiers, it is understood that it may be easily modified to accommodate manually readable identifiers.

After the pre-wash sort 20, the garments 12 are transferred to washing machines 30, where they are washed. For the purposes of this description, "wash", "washing" and "washed" may mean traditional laundering, dry cleaning, and the like and "washing machine" may refer to an apparatus for washing. After washing 30, the garments 12 are transferred to dryers 40 where they are dried. Alternatively, the garments 12 may be dried as they pass through a steam tunnel 60. Once dried, the garments 12 are transferred to an inspection station 50. At the inspection station 50, a worker may inspect the garments for damage such as rips, tears, missing buttons and such. After inspection, each garment 12 is configured for processing and placed on a conveyor 51. Garments 12 may be configured for processing by being hung on hangers, folded or the like. The garments 12 may be delivered as configured for processing or may be subsequently configured for delivery by being hung on hangers, folded or the like. In one embodiment, a garment 12 is configured for processing by being hung from a clothes hanger 52 where the hanger 52 is attached to a carrier 54 that interfaces with the conveyor 51. The carrier 54 may have an identifier (not shown) thereon. The identifier may be manually readable by workers or may be encoded in a machine readable format, such as a bar code, radio frequency (RF) chip, and the like. While the embodiment is described in the context of machine readable identifiers, it is understood that it may be easily modified to accommodate manually readable identifiers. A worker may then scan the garment's machine readable identifier. Once placed on the conveyor 51, the garment's machine readable identifier 22 and carrier's machine readable identifier may be automatically associated in the sorter's computer (not shown). Once on the conveyor 51, each garment 12 is conveyed to a repair station 70, the steaming station 60, or pressing station (not shown). Alternatively, the garments 12 may be steamed or pressed any time after washing, or not at all, and do not necessarily have to be steamed or pressed prior to sorting. While the garments 12 are being conveyed, the carrier 51 may be read at various points along the conveyor. Alternatively, it may be unnecessary to use carriers 54. Instead, a machine readable identifier in the garment 12 may be read during conveying.

The garments 12 not needing repair are steamed 60 to reduce wrinkles and conveyed to and collected in a pre-sort buffer 80. For the purposes of this description, a "buffer" is a temporary accumulation of garments as part of serialized operations. For example, a buffer may hold garments 12 pending a predetermined subsequent operation. In such case, a buffer is coupled to a designated operation. Typically, a buffer would hold garments on the order of magnitude of hours. For instance, a buffer may hold garments 12 for less than eight working hours where "working hours" means the hours of operation of a laundering facility and does not include breaks such as overnight, when the facility is closed, or machine downtime for such things as repair, maintenance and the like. Furthermore, "pre-sort buffer" will refer to a type of buffer where garments are presorted based on route and temporarily accumulated as an immediate preceding step to a sorting operation.

The pre-sort buffer 80 consists of several rails 82, where each route is temporarily assigned to one or more rails. Based on reading the machine readable identifiers, each garment is conveyed to a pre-sort buffer rail 82 corresponding to its route. Once all, or a substantial majority, of the garments 12 for a route are collected on a rail 82, the garments 12 may be directly conveyed to a sorter 90 where they are sorted by delivery sequence within the route. For instance, the sequence may be the order of deliveries to customers, by employees within a customer, by type of clothing, or any other order deemed desirable. Sorting may be performed manually by one or more workers or by sorting machines 90. Once sorted, the garments 12 are automatically and immediately conveyed to storage 100 where they are stored until they are scheduled to be loaded for delivery 120. For the purposes of this description, "storage" will refer to longer term holding, often, but not necessarily, encompassing a magnitude of days. Storage 100 is often where garments are kept prior to loading on a truck 10, but may also include a temporary holding area for garments to be removed from the route prior to their delivery to a stockroom (not shown). Storage may also have no predetermined subsequent process step. For instance, one or more garments in storage could be routed to a variety of different locations or processes (e.g., repair, loading, removal, sorting, resorting, etc.).

The garments 12 conveyed to the repair station 70 are repaired. Once a garment 12 is repaired, it may be placed onto the conveyor 51 and conveyed to the steaming station 60, to the pre-sort buffer 80 and sorted 90 and stored 100 with other garments 12 of the route. However, if the route has already been sorted, the repaired garment 12 may be placed onto the conveyor 51, conveyed to the steaming station 60, to the pre-sort buffer 80, sorted 90, and a worker will then have to manually place the garment 12 in its proper place within storage 100 (e.g. with the garments 12 for the same customer, with the garments 12 for the same employee of the customer, etc.).

Also, from time to time, it may be necessary to add new garments 12 to the route (e.g. for a new employee of a customer, etc.), add stragglers, or remove garments 12 from the route (e.g. for an employee who no longer works with a customer, etc.) 110. For the purposes of this disclosure, "stragglers" will refer one or more garments 12 associated with a route that are separated from the remainder of the route. For example, a straggler may be a garment that is inadvertently left on or near the delivery vehicle 10, dropped on its way to a washing machine 30 or a drying machine 40, delayed in another process, separated from its hanger 52, separated from the conveyor 51, etc. For a new garment 12 or straggler, the garment 12 may be placed onto the conveyor 51 and conveyed to the steaming station 60, to the pre-sort buffer 80 and sorted 90 and stored 100 with other garments 12 of the route. However, if the route has already been sorted, a worker will have to manually place the garment 12 in its proper place within the route within storage 100.

Figure 2:
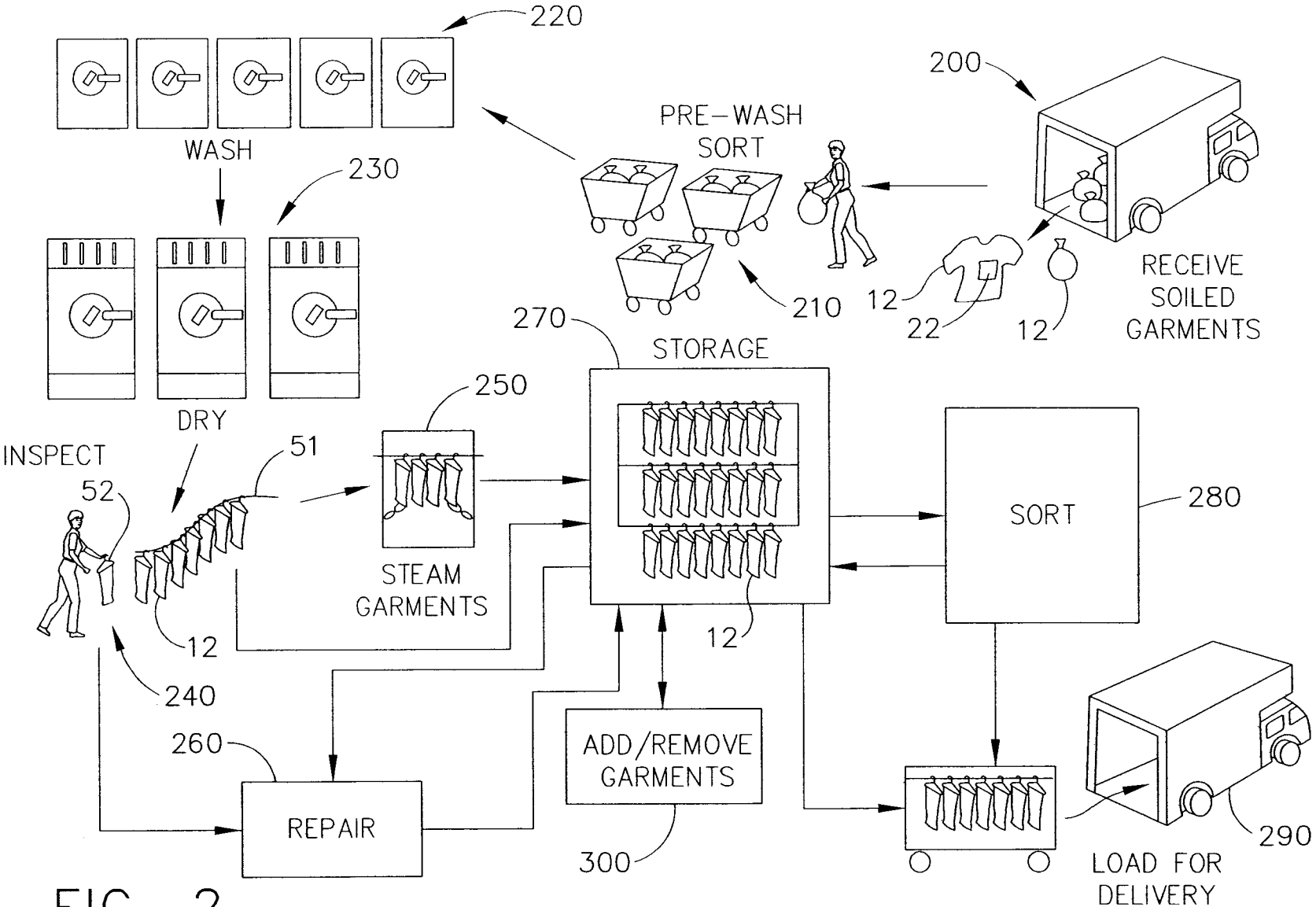
FIG. 2 is a schematic representation of an example of a process for laundering, drying and sorting garments incorporating a multi-destination storage capability in lieu of a required pre-sort buffer.

Referring now to FIG. 2, another embodiment of a process for laundering, drying and sorting garments is shown. Garments 12 are delivered to the laundering facility by delivery vehicles 200, typically delivery trucks. Each delivery of soiled garments corresponds to a specific route. The soiled garments are unloaded from the vehicle and may undergo a pre-wash sort 210 where the garments may be separated by the type of garment 12 (e.g. garage wear, lab wear, etc.), by color (e.g. light, dark, etc.) and the like. Each garment 12 may include a permanent or temporary unique identifier 22, such as an alphanumeric code, which may be unique to each garment or a class of garments. The identifier 22 may be manually readable by workers or may be encoded in a machine readable format, such as a bar code, radio frequency (RF) chip, and the like. While the following embodiment is described in the context of machine readable identifiers, it is understood that it may be easily modified to accommodate manually readable identifiers.

After the pre-wash sort 210, the garments 12 are transferred to washing machines 220, where they are washed. After washing 220, the garments are transferred to dryers 230 where they are dried. Alternatively, the garments may be dried as they pass through a steam tunnel 250. Once dried, the garments are transferred to an inspection station 240. At the inspection station 240, a worker inspects the garments for damage such as rips, tears, missing buttons and such. After inspection, each garment 12 is configured for processing and placed on a conveyor. In one embodiment, a garment 12 is hung from a clothes hanger 52 where the hanger 52 is attached to a carrier 54 that interfaces with the conveyor. The carrier 54 may have an identifier thereon (not shown). The identifier may be manually readable by workers or may be encoded in a machine readable format, such as a bar code, radio frequency (RF) chip, and the like. While the embodiment is described in the context of machine readable identifiers, it is understood that it may be easily modified to accommodate manually readable identifiers. A worker will then scan the garment's machine readable identifier 22. Once placed on the conveyor 51, the garment's machine readable identifier and carrier's machine readable identifier may be automatically associated in the sorter's computer. While the garments 12 are being conveyed, the carrier 54 may be read at various points along the conveyor 51. Alternatively, it may be unnecessary to use carriers 54. Instead, a machine readable identifier 22 in the garment 12 may be read during conveying.

Once on the conveyor 51, each garment is conveyed to a repair station 260, to a steaming station 250 (or pressing station (not shown)), or to storage 270. The garments may be steamed 250 to reduce wrinkles prior to being conveyed to storage 270, or the garments may be conveyed directly to storage 270 and steamed 250 at a later time. The garments 12 are grouped together in storage 270 based on route, but may be out of sequence. Based on reading the machine readable identifiers 22, each garment 12 is conveyed to a storage rail corresponding to its route. The garments 12 may remain in storage 270 until it is determined that they may be sorted. This determination may be based on proximity to delivery date, the sorter being idle and the like. In one embodiment, the garments may be stored for at least 8 working hours prior to sorting. In another embodiment, the garments 12 may be sorted less than 36 clock hours from when they are scheduled to be loaded for delivery; where "clock hour" means one of the 24 equal parts of a day. From storage 270, the garments 12 may be conveyed to a sorter 280 where they are sorted by delivery sequence within the route. For instance, the sequence may be the order of deliveries to customers, by employees within a customer, by type of clothing, or any other order deemed desirable. Sorting may be performed manually by one or more workers or by sorting machines. Once sorted, the garments 12 may be conveyed to a staging area (not shown) prior to loading for delivery 290, may be loaded for delivery 290, or may be conveyed back into storage 270 and loaded for delivery 290 at a later time.

Also, garments 12 may be conveyed to the repair station 260 from the inspection station 240, from storage 270 or from the steaming station 250. The garments conveyed to the repair station 260 are repaired. Once a garment 12 is repaired, it may be placed onto the conveyor 51, conveyed to the steaming station 250, or conveyed to storage 270 and stored with other garments 12 from the same route. If the route has previously been sorted, the garment 12 may be conveyed to the end of the rail for the route and the route may be re-sorted by the sorter 280 to include the repaired garment 12 in its proper position within the route. Once re-sorted, the garments 12 may be conveyed to a staging area (not shown) prior to loading for delivery 290, loaded for delivery 290, or conveyed back into storage 270 and loaded for delivery 290 at a later time. Also, from time to time, it may be necessary to add new garments 12 to the route (e.g. for a new employee of a customer, etc.), add stragglers, or remove garments from the route (e.g. for an employee who no longer works with a customer, etc.). For a new garment 12 or straggler, the garment 12 may be placed onto the conveyor 51, conveyed to the steaming station 250, conveyed to storage 270 and stored with other garments 12 from the same route. If the route has previously been sorted 280, the garment 12 may be conveyed to the end of the rail for the route and the route may be re-sorted by the sorter 280 to include the new garment, or straggler, in its proper position within the route. Once re-sorted, the garments may be loaded for delivery 290, or may be conveyed back into storage 270 and loaded for delivery at a later time. For garments that are to be removed from the route, they may be conveyed from storage 270 to the stockroom (not shown).

Figure 3:
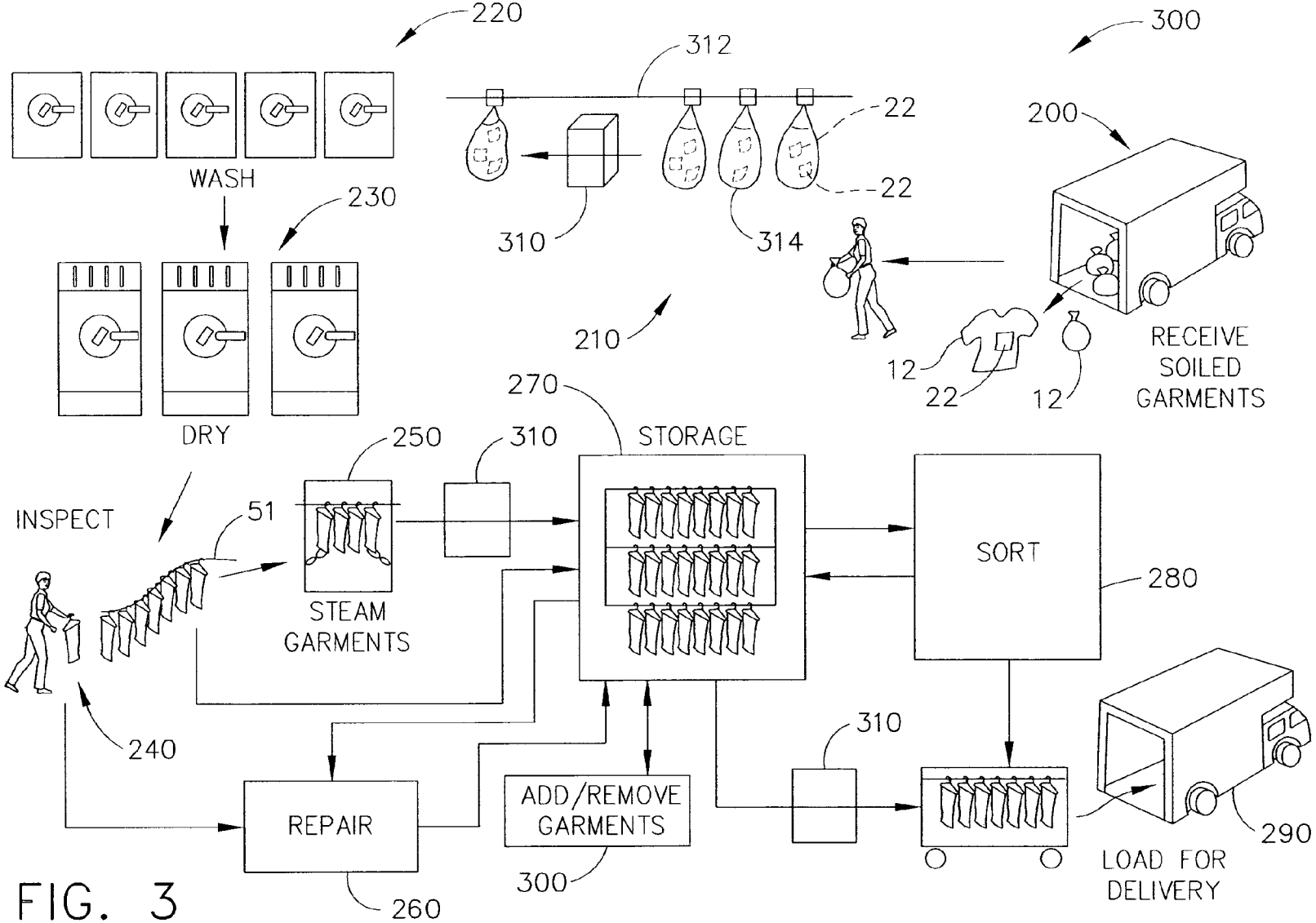
FIG. 3 is a schematic representation of an example of the process of FIG. 2 further incorporating a garment tracking system.

RFID AUTOMATED GARMENT PROCESSING. In FIG. 3, a process for laundering, drying and sorting garments is depicted that is similar if not identical to the process depicted and described above for FIG. 2, but with illustrative placement of sensing passive RFID tags 22. As mentioned above, placing RFID tags 22 on garments 12 enhances identifying and tracking garments 12 as processed through a garment processing plant 300. Although one or more stationary RFID reader antennas (interrogator) 310 are depicted at various locations, it should be appreciated that handheld, steerable antennas with direction gain, or additional stationary antennas may be incorporated as desired or warranted. Typically, the stations 310 are configured such that an RFID tag 22 passes through or travels past the reception area for the station 310. For example, a first station 310 is placed alongside an overhead rail 312 conveying a plurality of sling bags 314, each containing in turn a plurality of garments 12. Thus, the RFID tags 22 may be oriented in various directions (for instance, attached to a clean garment hanging on a hanger which is being conveyed on a conveyor, or attached to a soiled garment in a sling bag being conveyed on an overhead rail system). Illustrating other locations for RFID detection, another station 310 is placed alongside a hanger conveyor 316 between the steam tunnel 250 and storage 270 and a third station 310 is placed between storage 270 and delivery 290.

The RFID tag 22 is coupled electrically to the reader via electromagnetic induction (like the output coil of a transformer is coupled inductively to the input coil), both for providing power to the garment tag (i.e., the garment tag is passive, meaning it uses the power it receives from the reader signal to operate), and for communicating data between the garment tag and the reader (and optionally also from the reader to the garment tag).

To get sufficient inductive coupling between the reader antenna and the garment tag antenna for successful communication between the reader and the garment tag, a certain minimum amount of magnetic flux generated by the reader antenna has to pass through the antenna coil of the garment tag 12. If the garment tag is parallel or nearly parallel to the lines of magnetic flux at the point in space where the garment tag is located, sufficient inductive coupling will not be achieved.

One typical approach to incorporating an RFID antenna into a garment 12 is to embed a tag antenna (not shown) within a protective coating or within a fluid impermeable pouch (not shown). This prevents contamination or physical damage to the very fine copper wire or lithographically applied conductive traces on printed circuit board of the garment tag coil. To get sufficient coupling, the plane of the garment tag coil (although the garment tag coil wouldn't necessarily have to be planar) has to be penetrated by a certain concentration of magnetic flux lines at an angle sufficiently perpendicular to the plane of the garment tag coil.

In some applications, it is advantageous to use materials of high magnetic permeability (for example, magnetically-soft ferrites) to direct, steer, or shape the magnetic flux generated by the reader antenna 310 in such a way that as the garment tag 22 passes through the field of the reader antenna, it will, at some point along its path through space, encounter at least one place where the local intensity and direction of the lines of magnetic flux generated by the reader will be sufficient to allow successful communication with the reader. Previous attempts to create this condition necessary for successful communication have relied on one or more of the following: (a) physically varying the orientation of the garment tag antenna relative to the reader antenna 310 (by moving either the garment tag or the reader, or both) as it passes through the reader field; (b) using various shapes, configurations, and combinations of active and passive reader coils and other antenna elements (e.g., closed- or open-loop reflectors) that are electrically conductive; (c) electrically or electronically switching the reader signal between various antenna configurations or orientations; (d) passing the garment tag through or beside multiple readers with different antenna configurations or orientations.

However, generally-known approaches fail to address shaping the detection magnetic field by use of materials of high magnetic permeability specifically for the purpose of directing or shaping the magnetic field generated by the reader antenna coil or coils to overcome tag orientation problems, although similar magnetic materials have been used for the purpose of shielding RFID reader fields from adjacent regions of space or from electrically conductive structures or devices.

Figure 4:
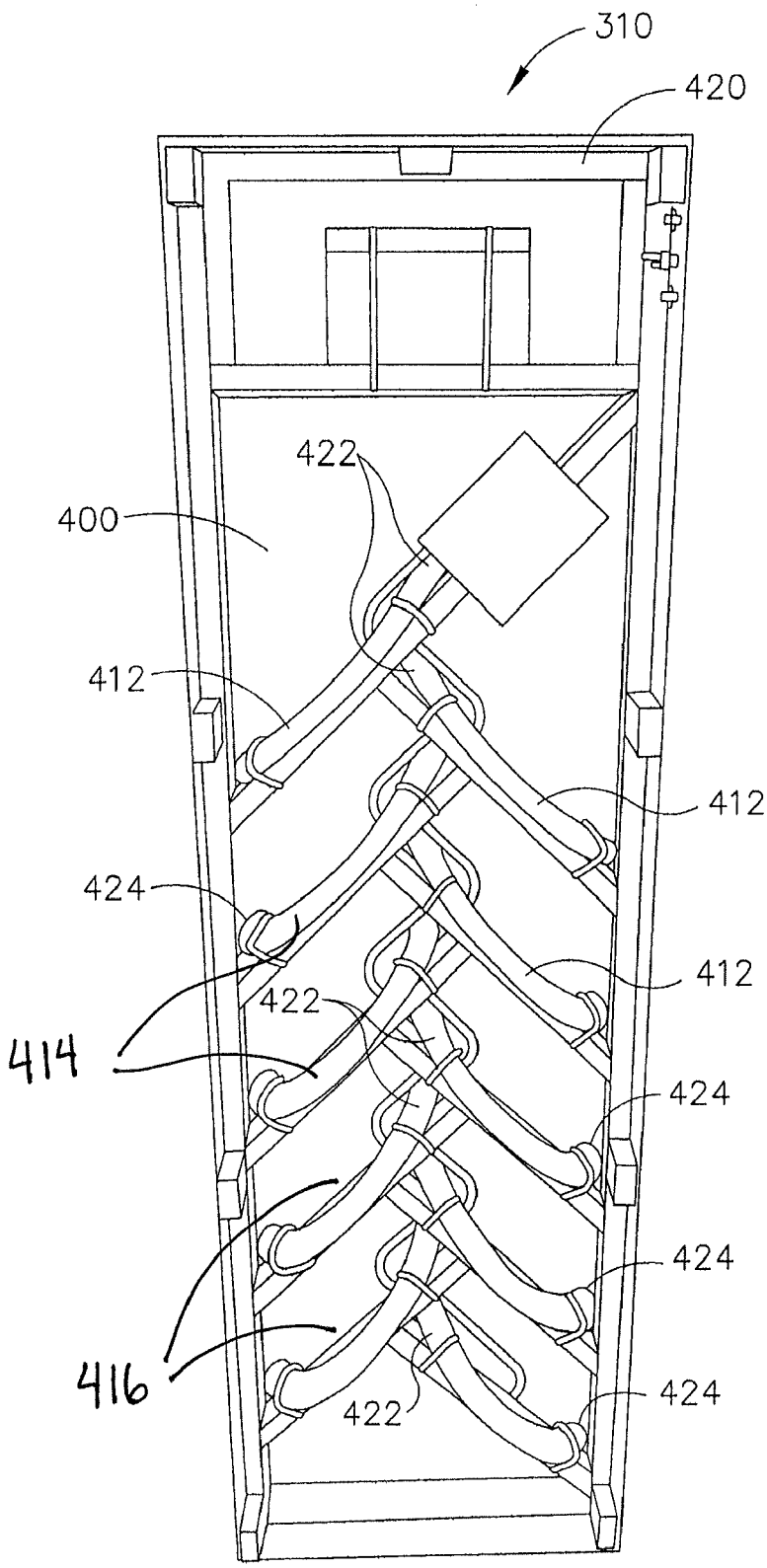
FIG. 4 is a rear view in elevation of a Radio Frequency Identification (RFID) Reader Station with a rear cover removed for the garment tracking system of FIG. 3.
Figure 5:
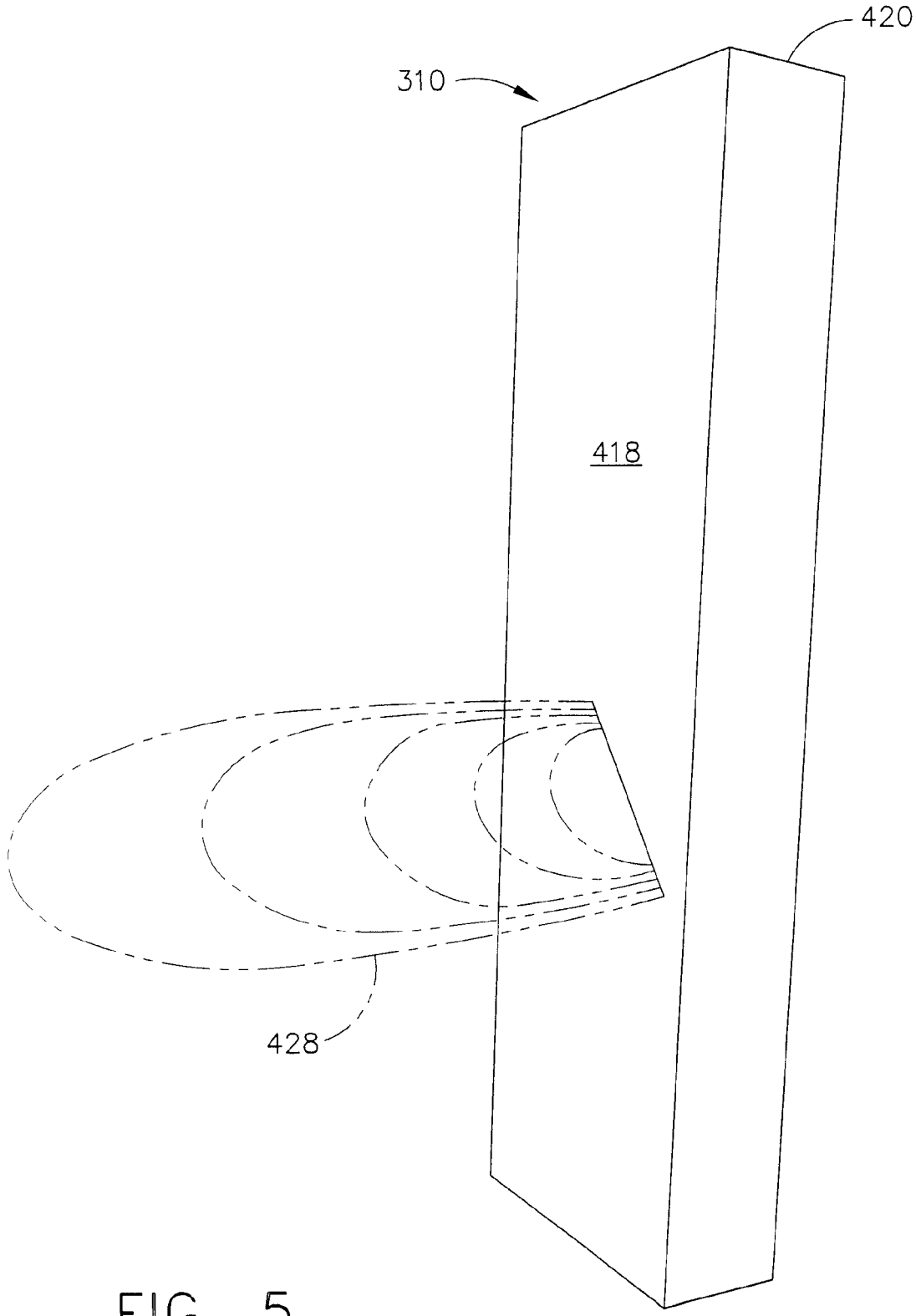
FIG. 5 is an isotropic view of the RFID Reader Station of FIG. 5 with a magnetic flux diagram depicted for one ferrite horseshoe element.

In FIGS. 4-5, an illustrative reader antenna 310 includes a generally vertically aligned serpentine conductor (e.g., copper pipe) 400 formed of alternating left and right rounded right angle bends 412. For each bend 412, a respective shallow ferrite horseshoe 414 is placed with its opening 416 toward a front surface 418 of a rectangular cabinet 420 that transversely faces the path of the sling bags 314. An inner arm 422 of each horseshoe 414 is vertically aligned with the other inner arms 422, residing inside of the laterally pointing apex formed by each bend 412. The outer arm 424 of each horseshoe 414 is positioned vertically lower than the inner arm 422 of the same horseshoe 414 and on the other side of the bend 412. Each horseshoe 414 alternates, approximately perpendicularly aligned with vertically adjacent horse shoes 414 and parallel to each horseshoe 414 above and below respectively the two that are adjacent. With particular reference to FIG. 5, each horseshoe 414 forms a canted magnetic flux field 428 such that any RFID tag 22 passing by the front 418 of the reader antenna 310 passes through flux fields 428 of multiple orientations ensuring a successful read.

The use of these magnetic materials for the purpose of overcoming tag orientation problems also provides the additional benefits of: (a) making the reader antenna 310 more efficient by concentrating more of the energy of the generated magnetic field in the desired "read zone" of the reader antenna, and also by providing a lower reluctance path for the magnetic flux to travel through the non-read-zone regions of space; (b) reducing stray magnetic fields outside the read zone of the antenna which could cause undesired effects such as electromagnetic interference or health concerns; (c) creating a more compact read zone with well defined boundaries (important in some applications, for instance where one desires to know from the garment tag reads the order or spacing of tags that are conveyed sequentially into the read zone, or where one wishes to write information specifically to tags in the read zone without also writing it to nearby tags just outside the read zone).

GARMENT ZIPPER SORT. With enhanced automated tracking of individual garments 12, further enhancements are enabled with this ability to individually identify garments. The invention generally relates to garment processing in automated garment processing facilities. After garments are laundered, they are hung on hangers, each garment is given a unique serial number, and the garments are transported about the facility along conveyor rails. As garments are processed in an automated facility, they generally end up being out of order. The conveyor rails can branch, garments can be selectively routed along the various branches, and garments can be accumulated along rails.

A random sequence of garments are accumulated in the initial buffer, which could entail a pre-sort buffer, a hanger conveyor, or a storage unit. As the garments 12 enter the initial buffer, they are scanned to determine their serial numbers. Once the conveyor buffer is completely populated (which could include 1000 or more garments), a computer system determines the correct sequence for the garments. Using a sorting algorithm (discussed in more detail below), the computer then calculates which garments 12 should be placed in which sorting buffers. The initial buffer is released and each garment 12 is conveyed to its respective sorting buffer. Once the sorting buffers are populated, one at a time a garment is released, in sequential order, from its sorting buffer until all the garments have been sequenced.

An example of the sorting algorithm is illustrated in Tables. As shown in Table I, a random sequence of ten garments are populated in an initial buffer. As shown in Table II, the first garment (#3) is conveyed to the first sorting buffer. As shown in Table III, the second garment (#7) is conveyed to the second sorting buffer. As shown in Table IV, the third garment (#4) is conveyed to the first sorting buffer. The process continues until the initial buffer is emptied. Table V shows the garments placed in the sorting buffers. Once the sorting buffers are populated, one at a time a garment is released in sequential order. As shown in Table VI, garments 0-3 have been sequenced. Table VII shows the sequencing process completed.

As described above, the sorting and sequencing is accomplished in a single batch run, but it is also contemplated that the sorting procedure could be accomplished in two or more iterations. With an iterative process, the garments leaving the sorting buffers would only be partially sequenced and would be conveyed back to the pre-sorting buffer to complete the sequencing.

Optionally, the rail downstream from the presort buffer could branch to enable bi-directional population of the sorting buffers. In other words, rather than populating the sorting buffers only from the top, the buffers could also be populated from the bottom. Thus, the number of sorting buffers could be reduced. Table VII illustrates an example of how the sorting buffers could be populated.

TABLE I

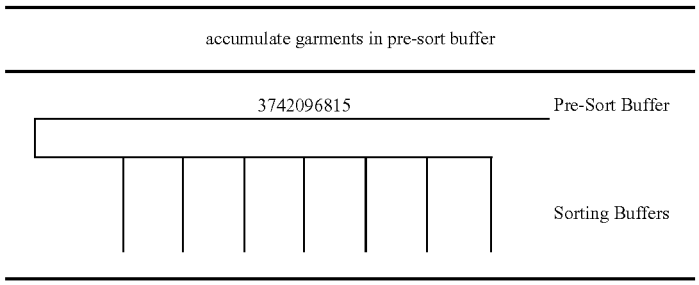

TABLE II
begin sorting garments
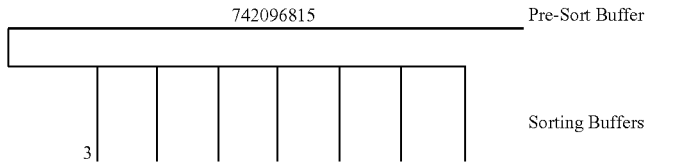
TABLE III
continue sorting
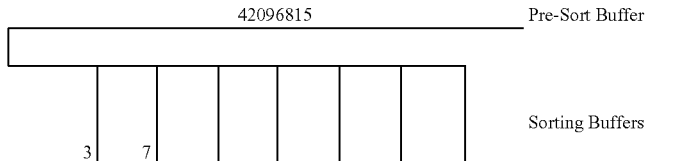
TABLE IV
continue sorting
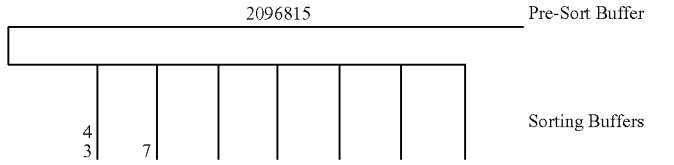
TABLE V
sorting completed
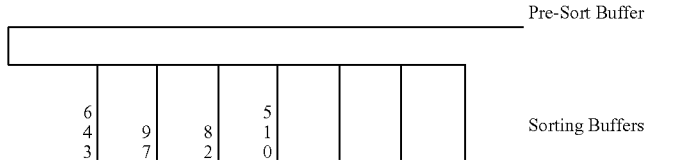
TABLE VI
sequencing garments
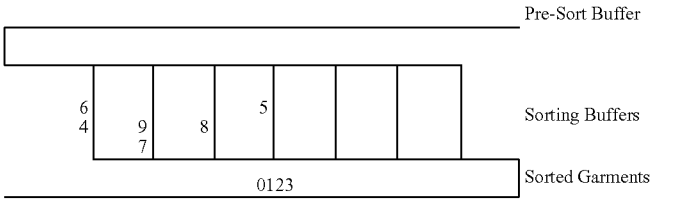

TABLE VII

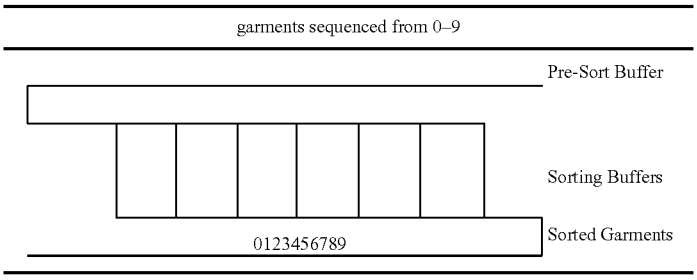

TABLE VII

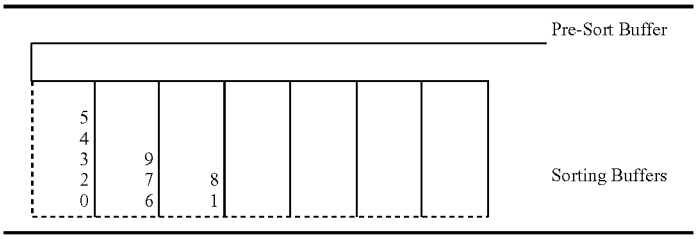

Figure 6:
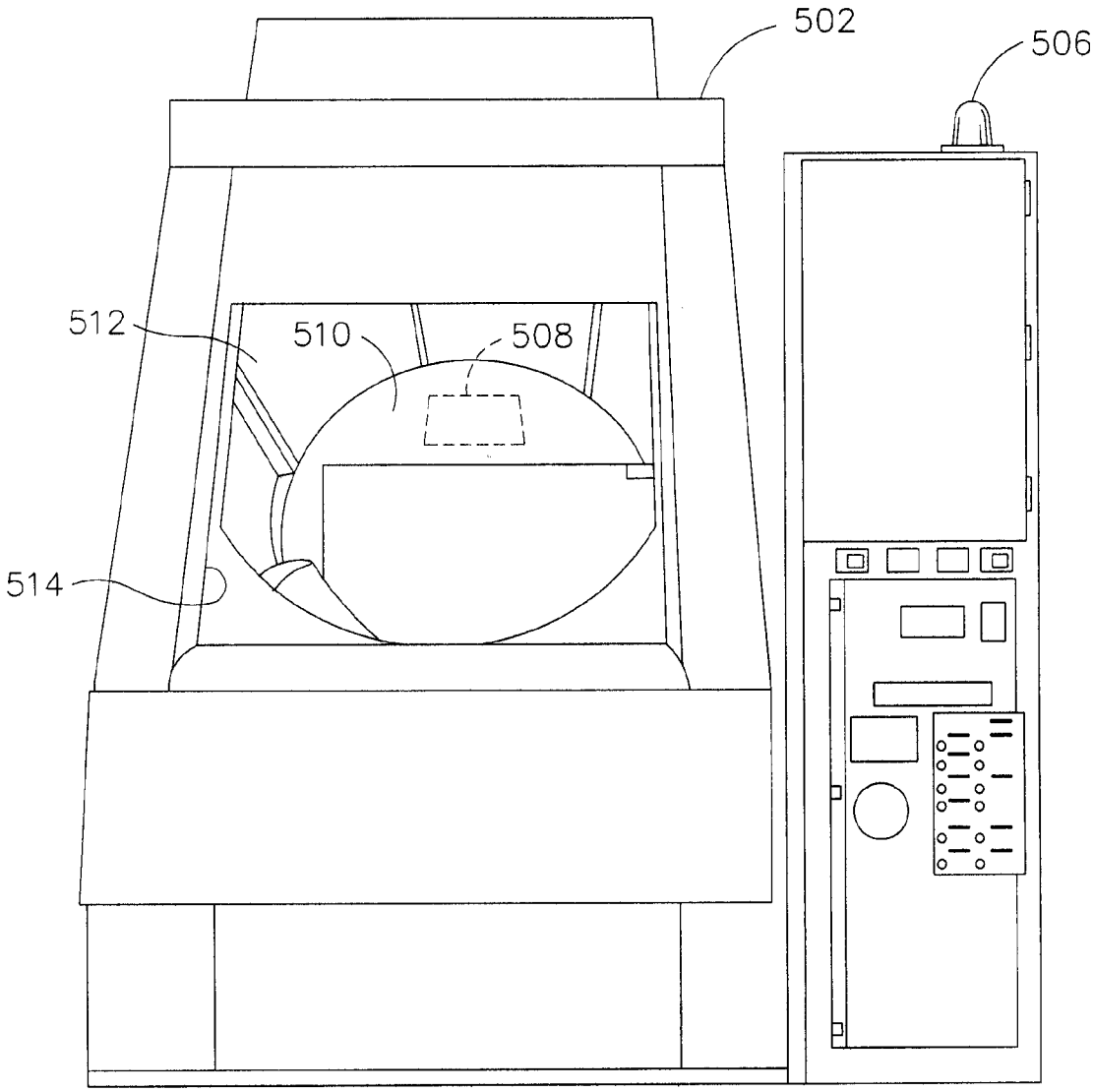
FIG. 6 is a front view of an illustrative pass-through garment dryer advantageously incorporating a drum RFID Reader Antenna for the processes for laundering, drying and sorting garments of FIG. 1, 2 or 3.
Figure 7:
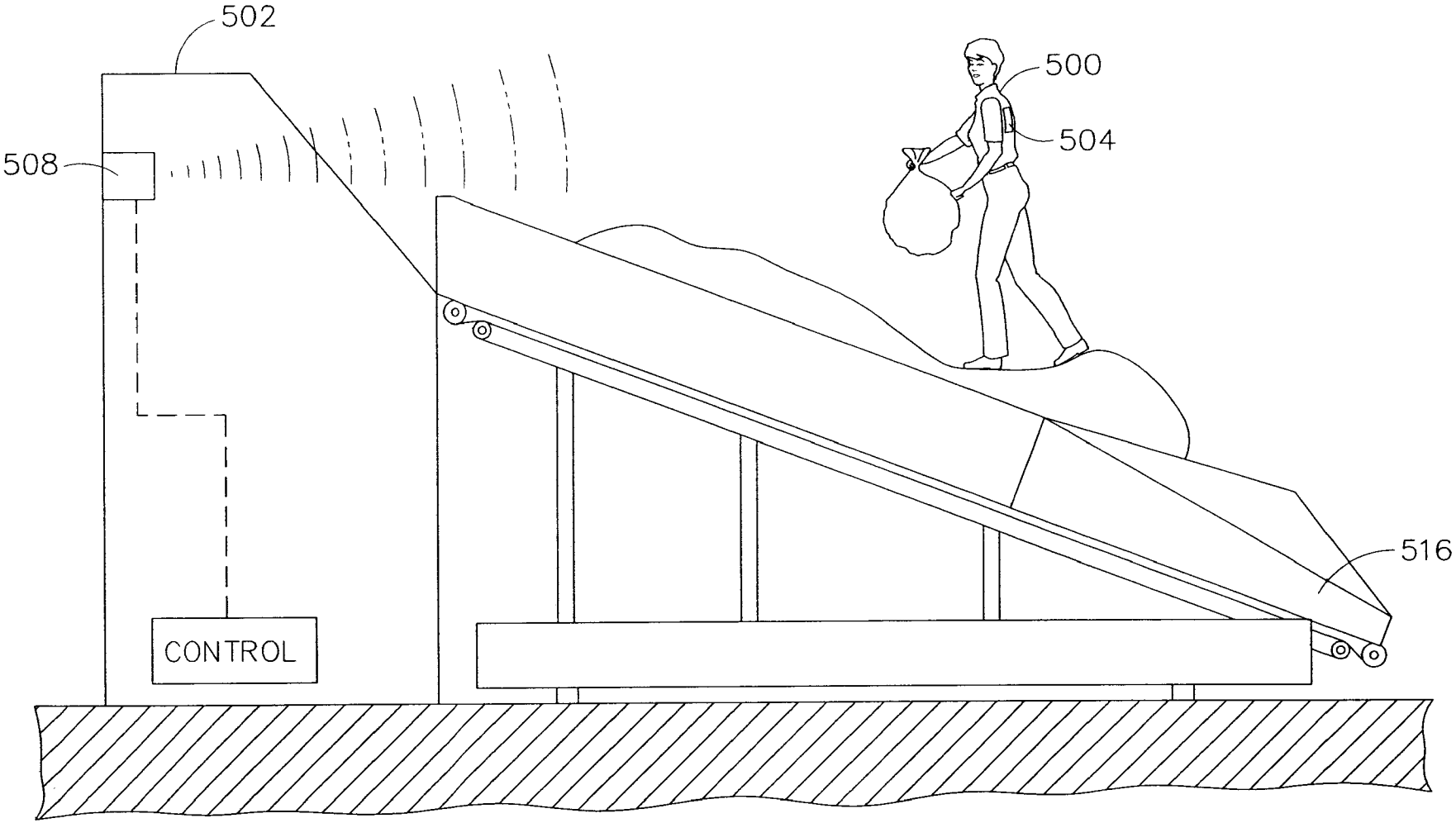
FIG. 7 is a side view of the pass-through garment dryer of FIG. 6 with an exemplary laundry conveyor system being misused.

RFID-BASED PERSONNEL SAFETY SYSTEM. In FIGS. 6-7, a person 500 entering, falling into, or being pulled into an industrial washer or dryer 502 can be seriously injured or killed. Because of how quickly the person 500 may fall or be pulled in, or just due to physical distances, the person 500 may not be able to actuate an emergency stop switch to deactivate the equipment. Generally known approaches have limitations, such as a fixed-location emergency stop switch. A person 500 may not have time or be able to physically reach an emergency stop button, cord, or crash-bar mounted on the equipment. Another example is a mobile emergency stop switch. An emergency stop switch may be worn by the person that communicates to the equipment via radio frequency signals. However, even though it is physically located on the person, the person 500 may still be unable to actuate it for any of several reasons, including the speed of events, or the person being subjected to violent motion, or being injured or incapacitated. Also, depending on where the receiving antenna is located, the radio frequency signals may be blocked by the metal enclosure of the equipment.

Advantageously, a badge or device 504 that may be worn or carried on the person 500 of someone working around dangerous equipment (e.g., industrial washers or dryers, document shredding machines) 502 that, when detected by the equipment 502 as being in a danger zone, would inhibit operation of the equipment 502 or would otherwise render it safe (e.g., stop motion and heat on a dryer), and optionally also set off an alarm 506. This device 504 may use radio frequency signals, either actively emitting them or using them passively (e.g., like an Electronic Article Surveillance, Surface Acoustic Wave, or Radio Frequency Identification tag) to make its presence known to the equipment.

In one possible implementation, an RFID (Radio Frequency IDentification) reader antenna 508 would be mounted on a non-rotating surface (for instance, on the inside of a dryer door) 510 such that the reader can detect RFID tags located anywhere within the interior of the dryer drum 512 and/or in close proximity to an opening 514 of the drum. On detecting the presence of an RFID tag which is normally worn by or carried on a person, the RFID reader antenna 508 would send a signal to the dryer 502 to cease all operations that may be hazardous to a person (i.e., in the case of a dryer 502, to stop the drum rotation and turn off the heat). The signal may also cause other adjacent equipment (e.g., a loading or unloading device 516) to be stopped or otherwise put into a safe state. The alarm 506 may also be activated to alert others to the person's possible need for assistance.

RFID PRIVATE PROTOCOL. With RFID, barcodes, or any other means intended to identify objects, animals, people, etc., there exist many problems with the potential for use of the identifying data by unauthorized entities (people, corporations, governments agencies, etc.), or for unauthorized purposes. For instance, these problems include compromising of the privacy of persons who can be associated with the identifying data, compromising of the security of data (such as social security or credit card numbers) that could be used to access financial or other confidential information, and compromising of data that could be used to track various activities of a person, corporation, or other entity.

A means is needed for the representation of the identifying data (code) to be changed, either each time it is read or based on time or other events, such that only those (authorized) readers with the proper non-public knowledge will be able to decipher from the changing representation a persistent, unchanging code that can be used to identify the object, animal, person, etc. The advantages of being able to uniquely identify garments 12 during laundering, sorting and delivering are thus retained while preserving the anonymity of wearers of a particular garment 12.

A two-step transformation on the persistent identifying code creates a changing representation that can be displayed, transmitted, or otherwise made available to a reader. First, a triggering event (time, a counter, an external signal, etc.) causes a random or pseudo-random or otherwise changing code to be generated or otherwise obtained. This code is then applied to the persistent identifying code in a way such that authorized readers will be able to extract or deduce from the resulting intermediate code, the original persistent identifying code. For instance, the random or pseudo-random or otherwise changing code could be simply appended or prepended to the persistent code, or interspersed (as individual digits in binary or any other specific base or combination of bases) among the persistent code at known locations, or multiplied by a constant code that is numerically larger than the persistent code and arithmetically added to the persistent code. Other means of application are also possible.

The second step of the transformation is to encrypt the intermediate code using any encryption means that will make it difficult or impossible for any reader or observer of the resulting representation to extract or deduce the original persistent identifying code without first decrypting the representation to recover the intermediate code in its unencrypted form. Only authorized readers will have access to the non-public key or keys required to perform this decryption, thus protecting the persistent identifying code from disclosure with strength at least equal to that of the encryption means used. Further protection may be afforded by the fact that certain additional information about how the random or pseudo-random or otherwise changing code was applied to the original persistent identifying code to create the intermediate code may be necessary in order to extract or deduce the original persistent identifying code from the intermediate code.

Security can be enhanced by recursively performing both the first and second steps of the transformation (in alternating fashion) multiple times, using different random or pseudo-random or otherwise changing codes and/or different means of applying said codes, and different encryption keys and/or different encryption algorithms. Alternately, the first step could be performed once and then selectively omitted between various multiple applications of the second step, using different random or pseudo-random or otherwise changing codes and/or different means of applying said codes, and different encryption keys and/or different encryption algorithms. Using asymmetric encryption algorithms (which use separate keys for encryption and decryption) provides the added security benefit that the non-public key or keys required to perform the decryption do not need to be known to or stored by the encrypting device or entity. Version identifiers can be appended to the representation to indicate to the reader which of multiple means of applying the random or pseudo-random or otherwise changing codes, encryption keys, encryption algorithms, and sequences of steps were used to produce the representation. These version identifiers can either be appended to the representation prior to the application of any subsequent transformation steps, or later in the transformation process, including after the final transformation step. The particular set of means of applying the random or pseudo-random or otherwise changing codes, encryption keys, and encryption algorithms used and the particular sequence in which they are applied could vary between different encrypting devices or entities, and/or could be different at different times on any given encrypting device or entity.

Figure 8:
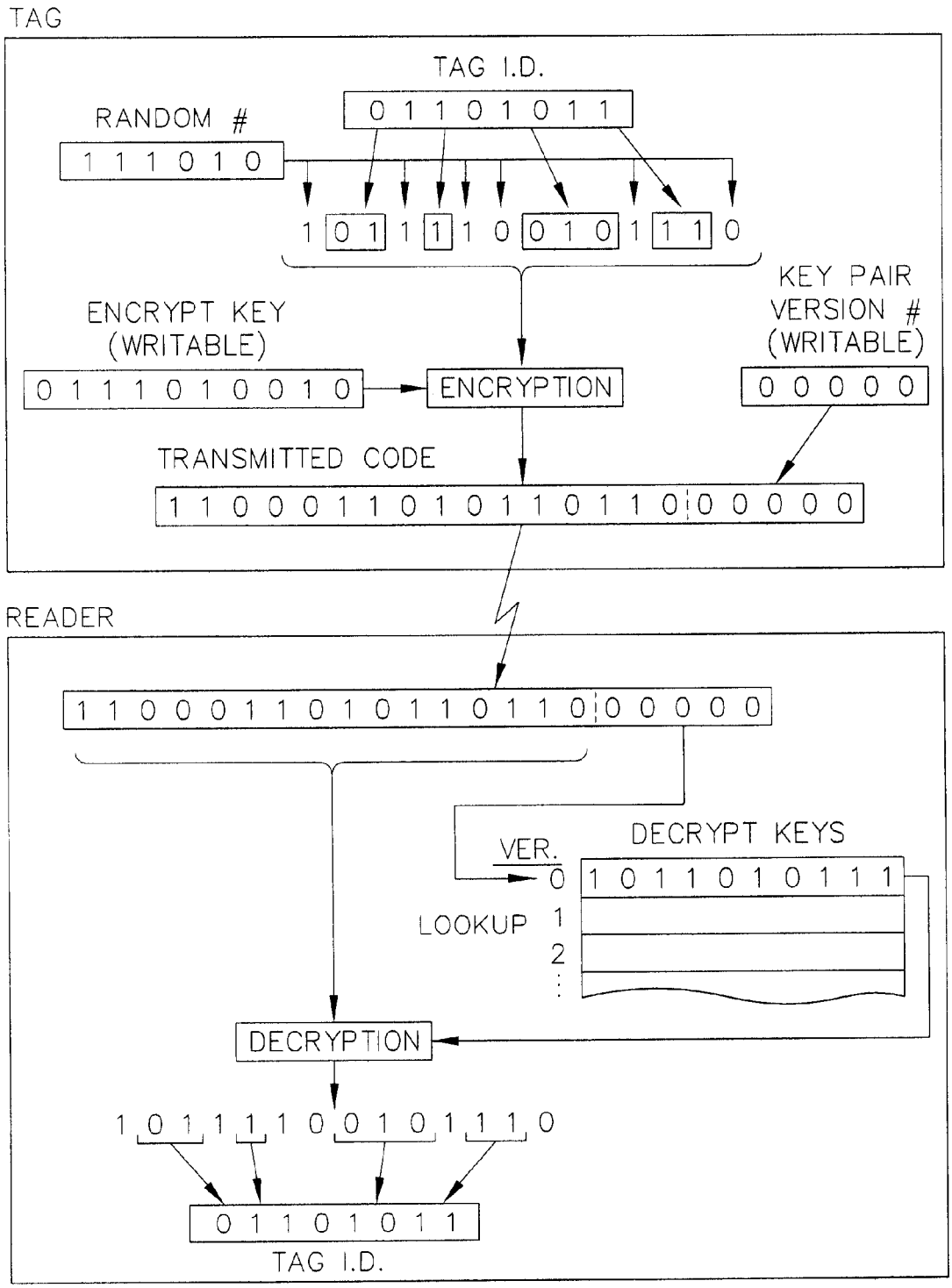
FIG. 8 is a diagram of an RFID tag and reader incorporating a two stage privacy algorithm.

The diagram of FIG. 8 shows an example of one possible implementation of this invention as it could be applied to the design of an RFID tag and reader. The values and lengths of all codes, keys, ID's, version numbers, and ID representations were arbitrarily chosen for illustrative purposes only.

It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

While the present invention has been illustrated by description of several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. An apparatus, comprising:

a plurality of garments;

a garment conveyor moving the plurality of garments within a garment processing plant;

at least one carrier coupled with the garment conveyor for moving the plurality of garments within the garment processing plant;

a plurality of transmitters, each transmitter configured with a unique identifier and attached to an article selected from the group consisting of a respective one of the plurality of garments and the at least one carrier;

an interrogation station positioned proximate to the garment conveyor to read each of the plurality of transmitters;

a sorter in communication with the interrogation station, the sorter being capable of sorting the plurality of garments according to the unique identifier of each of the plurality of transmitters;

wherein the interrogation station further comprises an antenna operably configured to extend a pair of non-aligned polarized electromagnetic interrogation signals toward the plurality of garments moved by the garment conveyor, the pair of signals being longitudinally aligned to permit a selected one of the plurality of transmitters passing through one of the pair of interrogation signals to subsequently pass through the other of the pair, which ensures reception regardless of orientation of the selected transmitter.

2. The apparatus of claim 1 wherein each of the plurality of transmitters further comprises radio frequency identifier identification circuitry.

3. The apparatus of claim 1, wherein the antenna comprises at least one conductive driving element for creating a magnetic field.

4. The apparatus of claim 3, wherein the at least one conductive driving element also receives signals from the plurality of transmitters.

5. The apparatus of claim 4, wherein each of the plurality of transmitters further comprises at least one passive element with relatively high magnetic permeability for modifying the created magnetic field.

6. The apparatus of claim 1, wherein the interrogation station further comprises;

an elongate structure tangential to a longitudinal axis defined by the movement of garments by the garment conveyor; and a plurality of pairs of nonaligned polarized electromagnetic interrogation signals, each pair positioned along the elongate structure to encompass the transverse extend of each garment moved by the garment conveyor.

7. The apparatus of claim 6, wherein the interrogation station further comprises:

a conductor extending along the elongate structure; and a plurality of horseshoe shaped ferrite members further positioned to shape each pair of nonaligned polarized electromagnetic interrogation signals.

8. An antenna for reading a transmitter, the transmitter being configured with a unique identifier and associated with at least one article, wherein the antenna is operably configured to extend a pair of nonaligned polarized electromagnetic interrogation signals toward the at least one article, the pair of signals being longitudinally aligned to permit the transmitter passing through one of the pair of interrogation signals to subsequently pass through the other of the pair, which ensures reception regardless of orientation of the transmitter.

9. The antenna of claim 8, further comprising:

an elongate structure tangential to a longitudinal axis defined by the movement of the at least one article by a conveyor; and a plurality of pairs of nonaligned polarized electromagnetic interrogation signals, each pair positioned along the elongate structure to encompass the transverse extend of the at least one article moved by the conveyor.

10. The antenna of claim 9, further comprising:

a conductor extending along the elongate structure; and a plurality of horseshoe shaped ferrite members further positioned to shape each pair of nonaligned polarized electromagnetic interrogation signals.

* * * * *